US005183157A

United States Patent [19]

Darden

[11] Patent Number: 5,183,157

[45] Date of Patent: Feb. 2, 1993

[54] PLASTIC BAG DISPENSING SYSTEM

[76] Inventor: Louis R. Darden, 8410 Gaylord Rd., Richmond, Va. 23229

[21] Appl. No.: 769,381

[22] Filed: Oct. 1, 1991

[51] Int. Cl.[5] ..... B65D 25/16

[52] U.S. Cl. ..... 206/390; 206/554; 206/494; 220/407

[58] Field of Search ..... 220/406, 407; 206/390, 206/395, 554, 489, 494, 820; 221/33, 34, 63, 97, 199

[56] References Cited

U.S. PATENT DOCUMENTS

| | | | |
|---|---|---|---|
| 3,392,825 | 7/1968 | Gale et al. | 220/407 X |
| 3,451,453 | 6/1969 | Heck | 220/407 X |
| 3,800,503 | 4/1974 | Maki | 206/390 X |
| 4,349,123 | 9/1982 | Yang | 206/390 X |
| 4,658,962 | 4/1987 | Burns et al. . | |
| 4,677,697 | 7/1987 | Hayes | 206/390 X |
| 4,714,191 | 12/1987 | Richardson . | |
| 4,721,226 | 1/1988 | Yurko | 220/407 |
| 4,850,507 | 7/1989 | Lemongelli et al. | 220/407 |
| 4,869,391 | 9/1989 | Farrington | 220/407 |
| 4,993,586 | 2/1991 | Taulbee et al. . | |
| 5,000,340 | 3/1991 | Leggio | 220/407 |
| 5,031,793 | 7/1991 | Chen et al. | 220/407 |
| 5,046,619 | 9/1991 | Hwang | 206/554 |

*Primary Examiner*—Paul T. Sewell
*Assistant Examiner*—Jacob K. Ackun, Jr.

[57] ABSTRACT

A container holds plastic bags which are sequentially linked together and removed one at a time. When the last bag is used and pulled out, the container from which the bags were stored follows the last bag.

4 Claims, 3 Drawing Sheets

PLASTIC BAG DISPENSING SYSTEM

BACKGROUND OF THE INVENTION

Retrieving bags from store rooms or closets is time consuming when the trash can has to be emptied and is full of trash. Before using plastic trash bags in trash cans, it was up to the person changing the trash to empty any garbage or debris. Sometimes it was up to the person changing the trash to wash the container due to spillage in the can itself before placing the trash can back in use. Almost everyone in every industry has turned to putting plastic trash bags into the trash cans so they can more easily remove the trash from the can and throw away the trash after the bag is full. Most industries having trash cans direct the employees to empty the trash bags when the bags are full. A more efficient, easier, cleaner and less cumbersome way of having these bags readily available has been needed for some time, especially using the fast food service industry as an example.

SUMMARY OF THE INVENTION

The invention is a system which puts the trash bags where they are most needed. Near the trash can is where trash bags are needed most. Then, when the full bag is removed, the next bag to replace it is near the full one just removed. This invention speeds up the process of changing the trash bags. Now, rather than taking valuable time to retrieve a bag in a back store room, the replacement trash bag is readily available from a container of trash bags lying beneath the bag in use. Because the bags are connected at a point of weakness and packed sequentially in a stack, the next bag to be used follows the full bag being removed. After all but the last bag are used up, this last bag is attached to a shelf in the container or to the container itself causing said container to follow the last bag as it is removed. Then, a new container of trash bags is put into the bottom of a trash can so that a large number of bags will remain at the bottom of the trash can for availability until that system of bags is used up also. Other details and advantages of the invention will become apparent with the following description of the embodiment and accompanying drawings.

DESCRIPTION OF ILLUSTRATED EMBODIMENT

Figure 1:
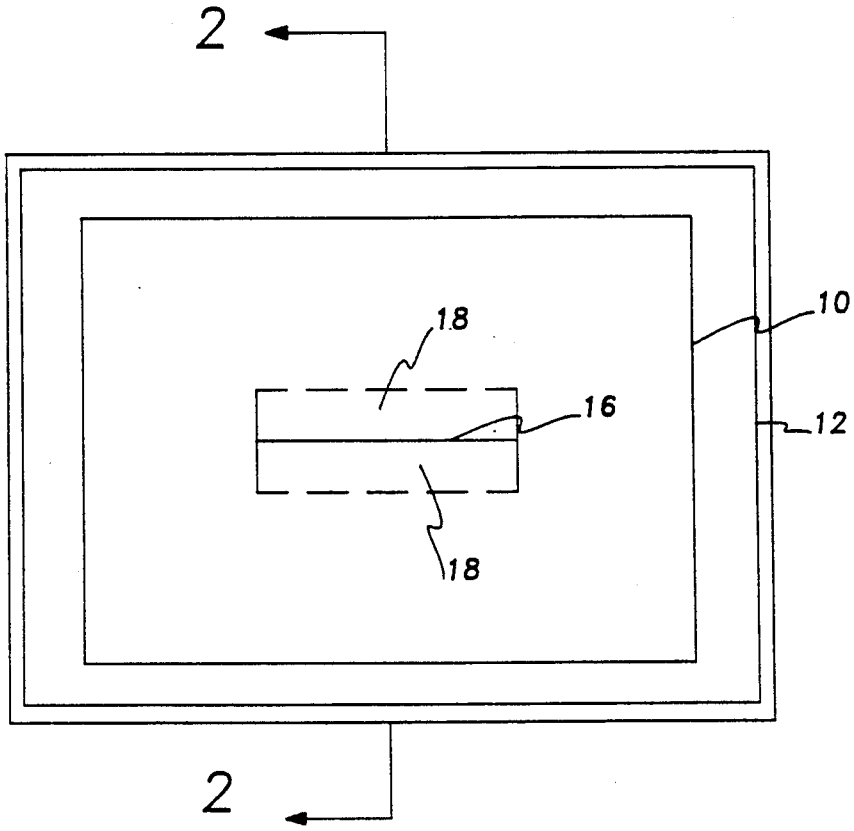
FIG. 1 shows a top view looking down into a trash can at an unopened container of trash bags lying at the bottom of the trash can.
Figure 2:
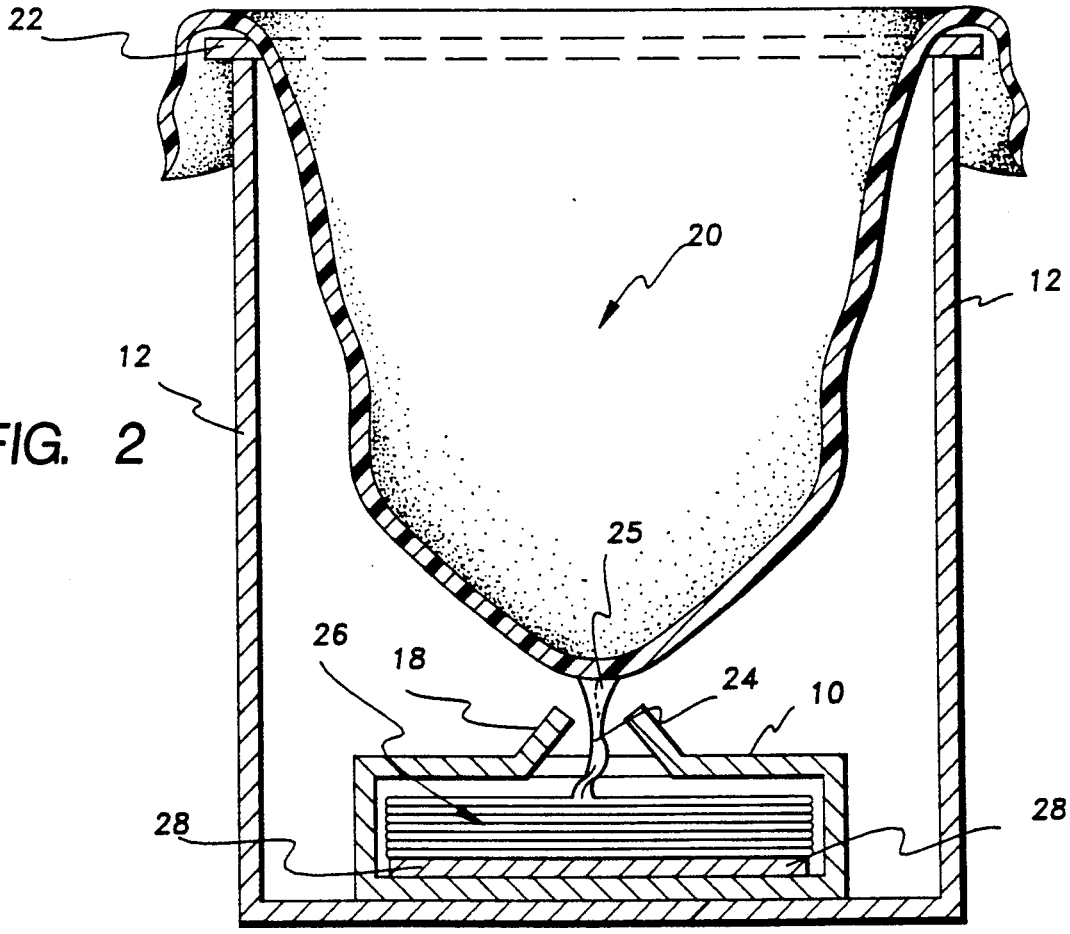
FIG. 2 shows a section on the line 2—2 in FIG. 1 after the container has been opened and a bag has been deployed from the container.

Referring now more particularly to the drawings, there is shown a plan view in FIG. 1 of a container holding the bags 10, resting in the bottom of a trash can 12. The container 10, has on its top an opening 16, with two hinged doorways 18, causing the doors to fold outward from the center of the opening 16. FIG. 2 encompasses the entire system in action where we see a deployed bag 20, dispensed from the container 10, secured around the top lip of the trash can 22. The next sequential bag 24, is attached at the bottom of the deployed bag 20 by tear lines in the form of perforations 25, extending transversely between them. The remaining bags in the box 26, are similarly attached to each other and all are folded into a stack. The last bag 27, in this stack is secured to a shelf 28. The shelf is too large to exit the opening in the top of the container 10, so the container will follow the last bag as it is removed.

Figure 3:
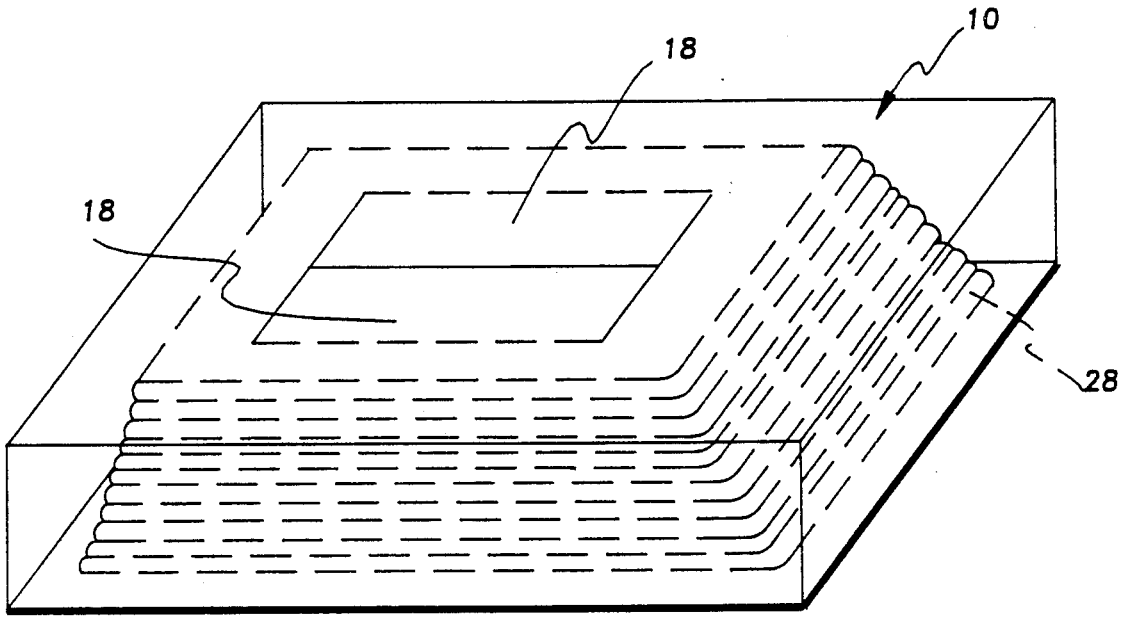
FIG. 3 shows a perspective view, in enlarged scale, of the unopened container showing phantom lines folded accordion style in a stack on a shelf in the bottom of the container.

FIG. 3 shows a phantom view of the closed container 10, with the bags inside resting on the shelf 28. After the hinged doorways 18, are opened, said opening in the top of the container will allow the bags to feed out of the container. The bags, folded accordion style one on top of the other and sequentially attached end to end by a line of weakness between adjacent bags and this allows easy detachment of one bag from the other.

Figure 4:
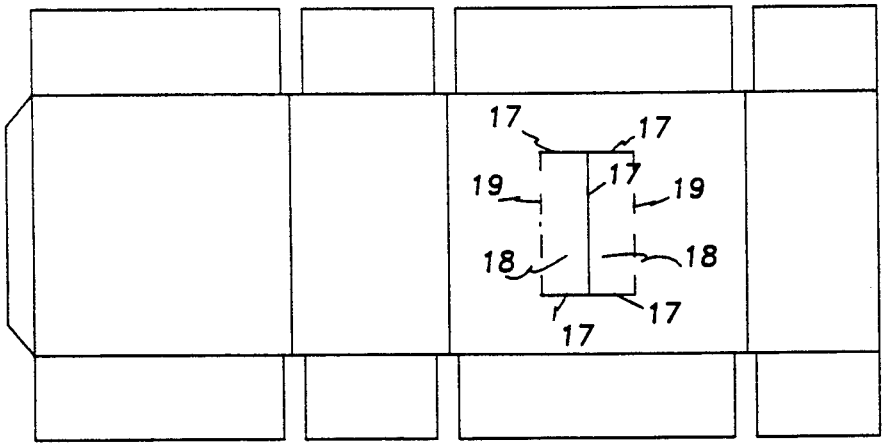
FIG. 4 is a view, in reduced scale, of a blank to form the container laid out flat before it is erected.

FIG. 4 is a view of the container blank laid out flat. It has the hinged doors 18, and the cuts in the top 17, and 2 perforated sides 19, acting as hinges for the opening.

Figure 5:
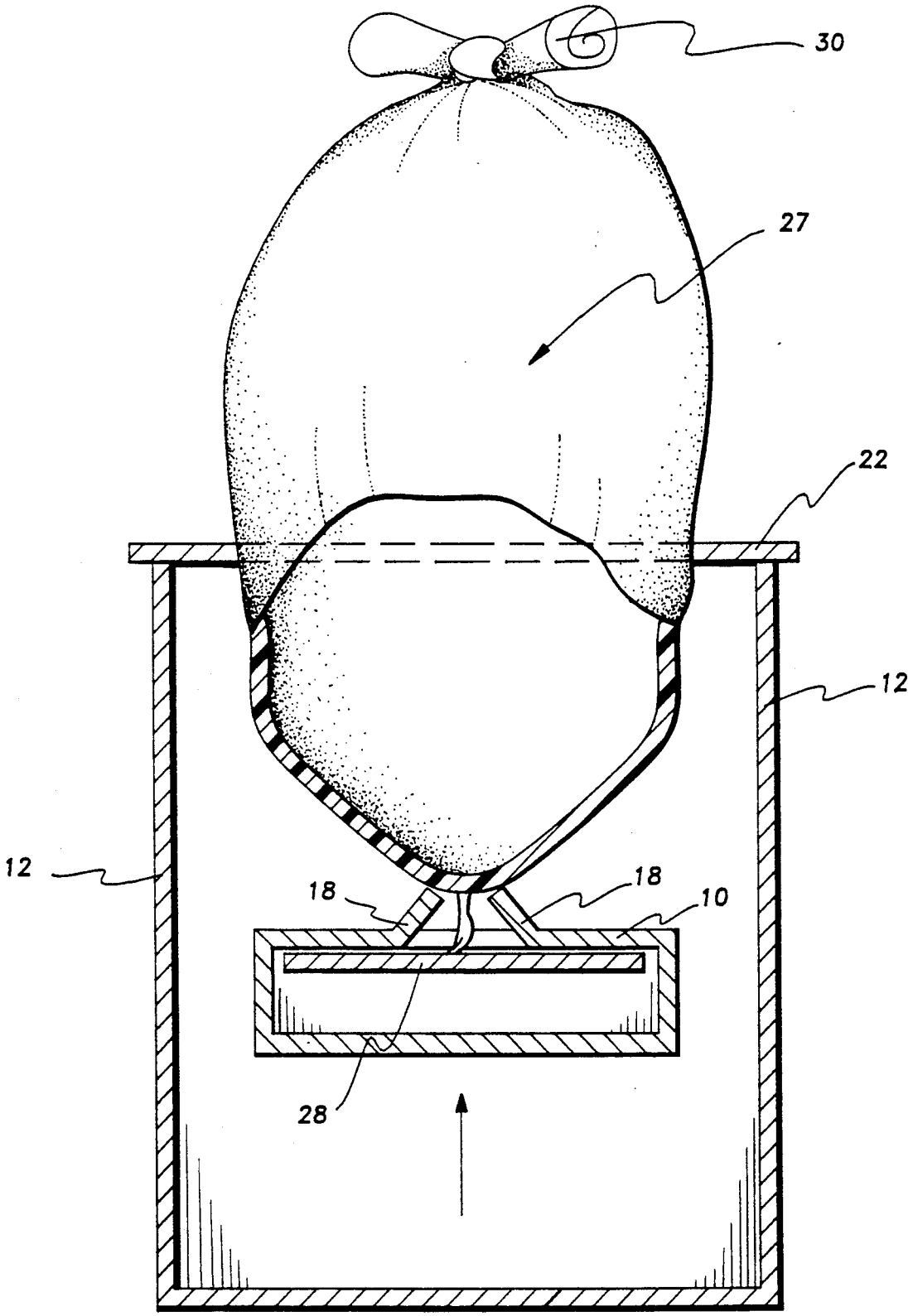
FIG. 5 is a sectional view corresponding to FIG. 1 but showing the last bag attached to the shelf pulling up the container in the trash can.

FIG. 5 is a more precise view of the end of the system after all but the last bag have been used and this last bag 27, is full of trash, tied at the top 30, and being removed from the trash can 12. The shelf 28 is too large to exit through the opening in the top of the container 10 after the hinged doorways are open. This shelf is attached to the last bag 27, causing the shelf to pull the container up with the last bag out of the trash can 12.

Whereas a particular embodiment of the system has been described herein above, it will be evident to those skilled in the art that numerous variations of the details may be made without departing from the invention as defined herein. The effect on the fast food industry is an example but the invention has numerous applications in all industries.

What is claimed is:

1. Bag dispensing apparatus comprising a container having a restricted opening, a series of bags positioned in the container and sequentially removable through said opening, said bags being connected in sequence and folded into a stack, a line of weakness between each pair of adjacent bags to permit separating them by tearing across the line of weakness, and means to prevent the last bag of the sequence from being detached from said container.

2. Apparatus according to claim 1, in which said prevention means is a member positioned in the box, attached to said last bag of the sequence, and not removable through said opening.

3. Apparatus according to claim 2, in which said member is a shelf too large to pass through said opening and not attached to said container.

4. Apparatus according to claim 3, in which said container is a rectangular box having four folded sides, the area covered by three of said sides being large enough to permit entry into the box of said stack of bags with said attached shelf before the other one of said sides is folded in place.

* * * * *